United States Patent [19]

Zodrow et al.

[11] Patent Number: 4,912,905

[45] Date of Patent: Apr. 3, 1990

[54] CONTACT PRESSURE ELEMENT FOR METAL FOIL BLANKS LAID AROUND THE NECK AND HEAD OF BOTTLES IN A LABELLING MACHINE

[75] Inventors: Rudolf Zodrow, Düsseldorf; Josef Tomashauser, Willich; Rainer Buchholz, Düsseldorf, all of Fed. Rep. of Germany

[73] Assignee: Eti-Tec Maschinebau GmbH, Erkrath, Fed. Rep. of Germany

[21] Appl. No.: 194,633

[22] Filed: May 16, 1988

[30] Foreign Application Priority Data

May 19, 1987 [DE] Fed. Rep. of Germany ..... 3716713
Jun. 20, 1987 [DE] Fed. Rep. of Germany ..... 3720529
Aug. 29, 1987 [DE] Fed. Rep. of Germany ..... 3728958

[51] Int. Cl.[4] ..... B65B 7/28
[52] U.S. Cl. ..... 53/345; 53/362
[58] Field of Search ..... 53/345, 357, 359, 360, 53/362; 156/488; 72/60, 54, 465

[56] References Cited

U.S. PATENT DOCUMENTS 2,086,552 7/1937 Hogg ..... 53/362
2,112,842 4/1938 Hogg ..... 53/345
2,885,851 5/1959 Aldington ..... 53/357
4,494,393 1/1985 Bruce ..... 72/465

FOREIGN PATENT DOCUMENTS 1062341 3/1967 United Kingdom ..... 72/465

*Primary Examiner*—Lowell A. Larson
*Attorney, Agent, or Firm*—Sprung Horn Kramer & Woods

[57] ABSTRACT

The invention relates to a contact pressure element for metal foil blanks laid around the neck and top of bottles (3) in a labelling machine. Retained by a retaining ring (5) in front of the opening of a casing (1) having a bell-shaped inner wall (7) is a resilient plate (2) whose front side facing the end face of the bottle (3) is made of an open-pored resilient foamed plastics, the rear side of the plate (2) being constructed with closed pores and its peripheral edge being formed with an annular bead (8). When the contact pressure element makes an axial movement towards the end face of the bottle (3), the plate (2) yields to the axial pressure, its rear side rolling down the bell-shaped inner wall (7) in the zone of the annular bead (8), so that the front side of the plate (2) is brought into radial contact pressure with the side of the bottle top in the zone of the annular bead (8). Such contact pressure is produced without folding the plate (2) and substantially without warping.

9 Claims, 5 Drawing Sheets

FIG.10
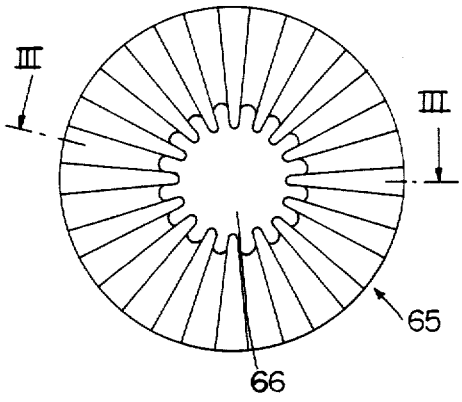
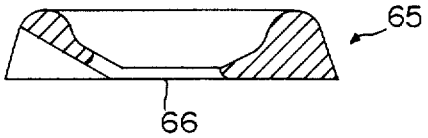
FIG. 11

CONTACT PRESSURE ELEMENT FOR METAL FOIL BLANKS LAID AROUND THE NECK AND HEAD OF BOTTLES IN A LABELLING MACHINE

BACKGROUND OF THE INVENTION

1. Field of the Invention

The invention relates to a contact pressure element for metal foil blanks laid around the neck and top of bottles in a labelling machine, the contact pressure element being movable axially towards the end face of the bottle top and having an internally bell-shaped casing and a resiliently deformable plate, more particularly a plate which is made of a resilient foamed plastics at least on its front side adjacent to the end face of the bottle top and which is disposed in front of the opening in the casing facing the end face of the bottle and bears on the rear side against the edge of the casing.

2. Discussion of Prior Art

Foil blanks, which in a labelling machine are laid around the bottle neck and top with the tip projecting over the end face of the bottle top must, when the tip has been folded over on to such end face, be pressed as smoothly as possible against the end face and the bottle top. In a contact pressure element for this purpose known from practical work and the Patent Literature (German Patent 34 37 283 A1) the resilient plate is built up from individual discs. The rear side disc of the plate comprises a flexible but non-extensible flat material in stellar shape and is sewn at a number of places to the resilient foamed plastics plate. When the contact pressure element is lowered on to the end face of the bottle, the plate is deformed while being simultaneously forced back against a resilient bearing element, and due to the rounded surfaces of the internally bell-shaped casing the plate is forced like a hood radially also against the sides of the bottle tops. It has been found that the resilient foamed plastics front side of the plate which acts directly on the metal foil blank becomes folded more particularly when the plate has such a large diameter that it can press the foil blank not only against the top edge of the bottle top, but to below the bottle top. Such a deformation of the plate side acting directly on the foil has an unfavourable effect on the foil blank surface, which must be as smooth as possible for optical reasons. It has also been found that when the pressure is applied the foil blank is subjected to such heavy tensile stressing that damage cannot always be avoided. The stressing is high because the plate is so constructed that when the contact pressure element is lowered, the plate must slide along the inside of the bell-shaped casing to enable it to apply itself in hood shape around the bottle top.

In another similar prior art contact pressure element which, however, has proved less useful in practice than the contact pressure element having the resilient plate made up of individual discs, a foamed plastics member taking the form of a solid or hollow frustrum is disposed in a cup-shaped casing which is adapted to the shape of the foamed plastic member and against whose walls and end the foamed plastic member bears (German Patents 31 53 154 and 34 37 283). Since the foamed plastics member bears against both the walls and the end of the conical casing cup, it can yield only to a limited extent when the bottle top is introduced into the foamed plastics member, so that the latter exerts pressure laterally on the bottle top. It has been found in practice that with this method of application the foil blank is heavily loaded, so that the solid frustrum has not proved acceptable in practice. It is true that conditions are more favourable with a hollow frustrum, but the foil material still remains heavily loaded.

SUMMARY OF THE INVENTION

It is an object of the invention to provide a contact pressure element using which the foil blank can be pressed against the bottle top as lightly loaded as possible, as smoothly as possible and over as large an axial length as possible.

In a contact pressure element of the kind specified, this object is achieved by at least the rear side of the peripheral edge of the plate being formed with an annular bead.

With the contact pressure element according to the invention the plate can with a low axial force be laid around the bottle top smoothly on all sides as far as the zone below the bottle top. There is no folding of the plate front side acting directly on the foil blank, neither is the foil blank subjected to dangerous tensile stressing. These effects which are positive for smooth contact pressure are due to the fact that, unlike the prior art, the rear side of the plate does not slide, but rolls down the rounded inner side of the casing, and the annular bead cooperates with the free cross-section of the bell-shaped casing, tapering in the axial direction thereof, to ensure that adequate radial pressure is still exerted on the bottle top even in the lower area thereof. This is boosted by the feature that due to its special shape, the length of radial rolling down of the plate rear side is larger than the diameter of the plate in the expanded condition.

DESCRIPTION OF AN EMBODIMENT OF THE INVENTION

An embodiment of the invention will now be described in detail with reference to the drawings, wherein FIGS. 1-3 show a contact pressure element in axial section at different phases of application, FIG. 4 shows an axial section through a contact pressure element in a different embodiment from that shown in FIGS. 1-3, FIG. 5 shows an axial section through a contact pressure element in a different embodiment from that shown in FIGS. 1-4, FIG. 6 shows a plan view of a rear side disc of the flexible plate shown in FIG. 5, FIG. 7 shows an axial section, taken along the line I—I in FIG. 6, through the disc shown therein, FIG. 8 shows a plan view of the front side of a foamed plastics disc of the flexible plate shown in FIG. 5, FIG. 9 shows an axial section, taken along the line II—II in FIG. 8, through the disc shown therein, FIG. 10 shows a plan view of a rear side disc of the flexible plate in a variant embodiment from that shown in FIG. 6, FIG. 11 shows an axial section, taken along the line III—III in FIG. 10, through the disc shown therein, and FIG. 12 and 13 show axial sections through a contact pressure element in an embodiment which is a variant of FIG. 5.

DETAILED DESCRIPTION OF THE EMBODIMENT OF THE INVENTION

Figure 1:
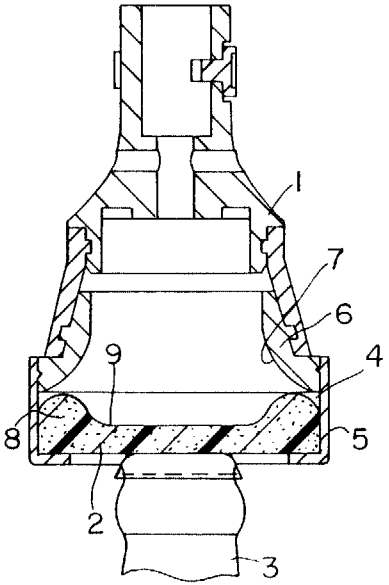
Figure 2:
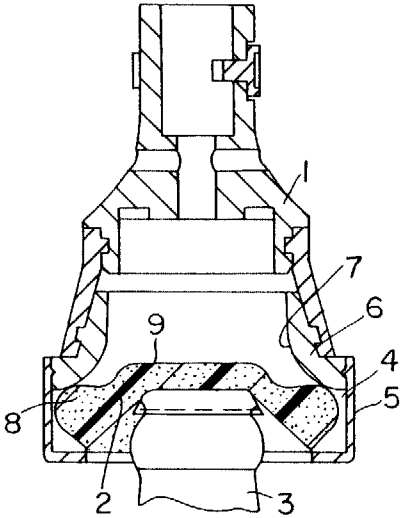
Figure 3:
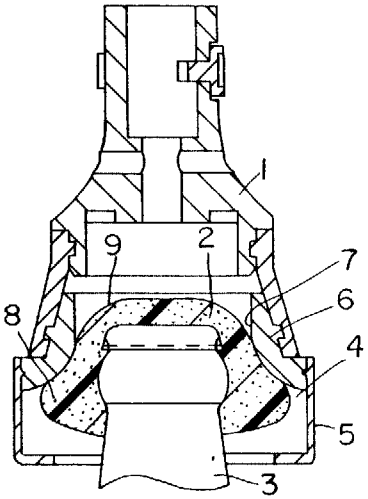

Referring to FIGS. 1 to 3, a contact element comprises a casing 1 and a flexible plate 2. The flexible plate 2 is disposed in front of the lower aperture 4, facing the end face of the bottle 3, of the casing 1 and is retained at that place by a retaining ring 5 clamped to the outside of the casing 1. The lower zone of the casing 1 is formed by an insert member 6 whose rounded inner wall 7 is bell-shaped.

The plate 2 takes the form of a foamed plastics member whose front side adjacent to the bottle 3 is constructed with open pores. The peripheral edge of the rear side of the plate 2 is formed with an annular bead 8. Apart from the front side constructed with open pores, the whole plate 2 is covered with a skin 9 formed by the closed-pore construction of the foamed plastics member.

The shape of the rear side of the plate 2 and of the inner wall 7 of the insert member 6 results in the plate 2 being deformed in the manner shown in FIGS. 1 and 3 when the contact pressure element moves axially in the direction of the bottle 3. The rear side of the plate 2 rolls down the bell-shaped wall 4 and the annular bead 8 ensures that the plate 2 is pressed by its front side outer edge radially against the sides of the bottle top. The pressing takes place free from folds and warping. When the contact pressure element has been lifted from the top of the bottle 3, recovery takes place solely due to the plate's own resilience.

Figure 4:
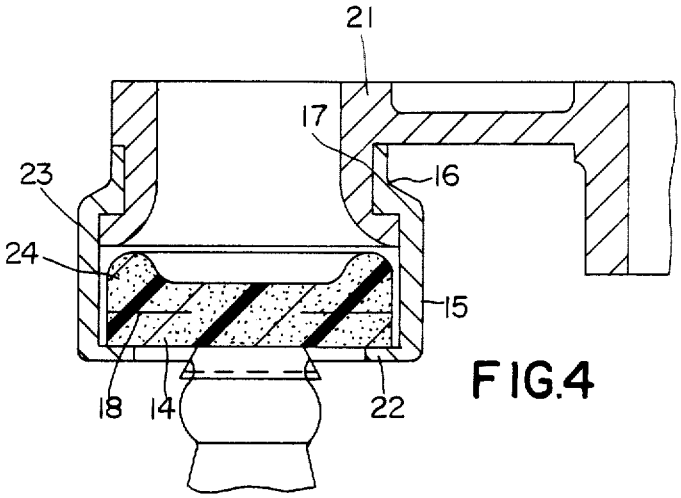
Figure 12:
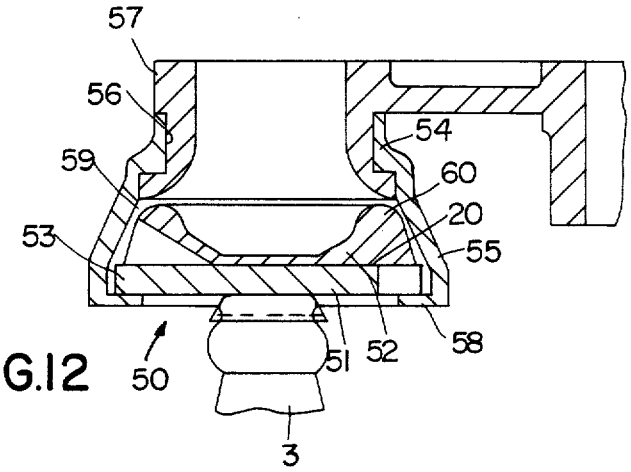
Figure 13:
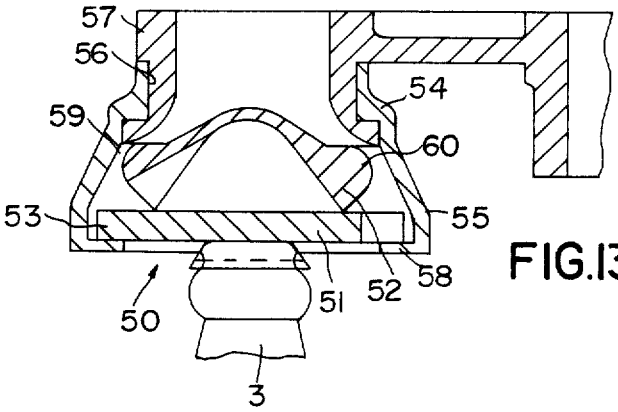

Experiments with one-piece plates 2 as in the examples illustrated in FIGS. 1–3 have shown that they have only a medium service life, due to a heavy stressing of their edge zones. However, their service life can be prolonged many times by a very simple step. In the case of the plates 14. 40, 50 of the embodiments illustrated in FIGS. 4, 5, 12 and 13, this step is the provision of a parting slit 18, 19, 20 extending substantially perpendicularly to the central axis at least in the edge zone, but preferably over the whole cross-section. The embodiments show that such a parting slit 18 to 20 can be put into effect both with a plate 14 made of a uniform material (FIG. 4) and also with a plate 40, 50 consisting of two discs 41, 52; 51, 52 (FIGS. 12 and 13), the front side disc 41, 51 being preferably made of foam rubber or the like. FIGS. 12 and 13 also show that the disc 51 facing the end face of the bottle 3 can have an annular collar 53 extending in the radial direction and enabling a greater axial height of the bottle top to be covered.

The embodiments illustrated in FIGS. 4, 5 and 12, 13 differ from the embodiment shown in FIGS. 1 to 3 only in the incised plates 14, 40, 50, but in the retaining rings 14, 45, 55. The retaining rings 14, 45, 55 are made of a resilient material, for example, rubber. They engage via a collar 16, 44, 54 in an outer annular groove 17, 46, 56 in the casing 21, 47, 57. The plates 14, 40, 50 are retained by a radially inwardly directed, readily deformable lip 22, 48, 58 in front of the opening 23, 49, 59 of the casing 21, 47, 57 against whose edge they bear via their annular bead 24, 30, 60. The plates 14, 40, 50 can readily be interchanged with the deformation of the lips 22, 48, 58.

Figure 5:
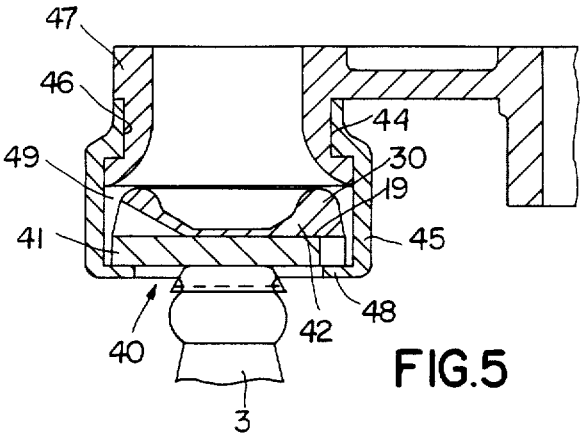

Another difference between the embodiments shown in Figs. 5, 12 and 13 and those shown in FIGS. 1 to 4 which further improves resistance to wear is that the plate does not take the form of a body of solid volume, but is radially ribbed.

In the case of the flexible plate 40 used in the embodiment shown in FIG. 5 the rear side disc 42 is made of a flexible, highly wear-resistant plastics. Moulded in the plate extending radially to the peripheral edge are ribs 33 between each of which gaps 34 are formed. The basic surface of each rib 33 is formed by a sector-formed zone bounded in the direction of the inner side of the plate 40 by a circle 35 whose diameter substantially corresponds to the diameter of the bottle top. The total periphery of the individual ribs 33 are the peripheral edge of the disc 40 is such that in the deformed condition of the plate 40 (FIG. 3) the ribs 33 are disposed without overlap, when they close the gaps 34. This is because in the undeformed condition the width of the ribs 33 corresponds substantially to the width of the gaps 34, and the height of the ribs 33 increases from the centre of the plate 40 to its edge.

The disc disposed in front of the ribbed disc 42 is made of an open-pored foamed plastics such as foam rubber. When the plate 40 is deformed, the disc 41 is so laid around the neck and top of the bottle 3 that the foil blank is pressed uniformly and smoothly against the top and neck of the bottle 3. The periphery ofthe disc 41 is formed with substantially radially incised notches 36 forming individual webs 37 which when the disc 41 is applied to the neck of the bottle 3 are disposed without overlap in relation to one another. This prevents the foamed plastics from becoming folded even in the zone of the peripheyr of the disc 41, so that even in this zone the foil blank is applied smoothly.

Figure 6:
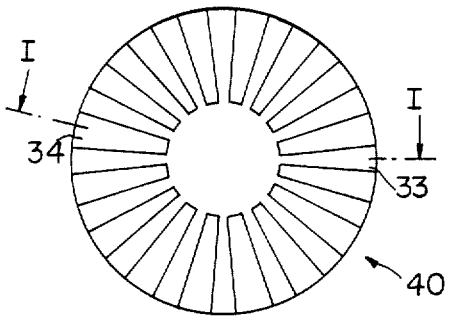
Figure 7:
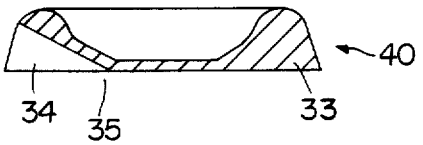
Figure 8:
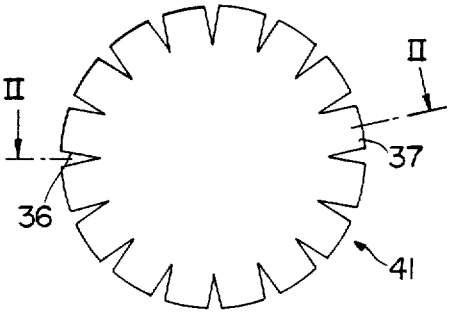
Figure 9:
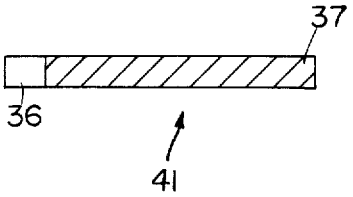

In contrast with the rear side disc 40 of the embodiment shown in FIGS. 6 and 7, the rear side disc 65 shown in Fig. 10 and 11 is formed in the central zone with an aperture 66 whose diameter substantially corresponds to the diameter of the top of the bottle 3. This produces a certain qualization of height, so that bottles of different heights can have foils applied without conversion of the contact pressure element.

It is true that the construction of the embodiment illustrated in FIGS. 12 and 13 substantially corresponds to the embodiment shown in FIG. 5, but its flexible plate 50 is differently constructed. Its front side disc 51 has a somewhat larger diameter than the rear side disc 52. Moreover, the rear side disc 52 is constructed after the fashion of a springing mechanism. Consequently, the disc 52 springs from the undeformed condition, as shown in FIG. 12, into the condition shown in FIG. 13 and contains the latter condition even after being expanded. Since the deformed condition has been maintained stable by the disc 52, application can now be so performed that with the axial movement of the bottle 3 against the plate 50 only the front side disc 51 is deformed by the pressure. The disc 52 is not appreciably deformed and now acts solely as a resilient abutment. The sheet 50 therefore experiences practically no wear. A contact pressure element of the kind specified is therefore more particularly suitable for use in a labelling machine making a very high number of strokes.

We claim:

1. A contact pressure element for metal foil blanks laid around the neck and top of bottles (3) in a labelling machine, the contact pressure element being movable axially towards the end face of the bottle top and having an internally bell-shaped casing (21, 47, 57) and a resiliently deformable plate (2, 14, 40, 50), which is disposed in front of the opening in the casing (1, 21, 47, 57) facing the end face of the bottle (3) and bears on the rear side against the edge of the casing (1, 21, 47, 57), characterized in that at least the rear side of the peripheral edge of the plate (2, 14, 40, 50) is formed with an annular bead (8, 24, 30, 60), and the plate (2, 14) is made of a resilient foamed plastic on its front side adjacent to the end face of the bottle top, the plate remote from the end face of the bottle top having ribs (33) which extend radially of the peripheral edge, in the undeformed condition enclose gaps (34) and in the deformed condition bear without overlap against the top and neck zone of the bottle (3).

2. A contact pressure element according to claim 1, characterized in that the plate has a parting slit (18, 19, 20) lying substantially perpendicularly to the central axis of the casing (21, 47, 57) and starting from the peripheral edge and extending over the whole cross-section.

3. A contact pressure element according to claim 2, characterized in that when the plate has a parting slit dividing it into two discs, the rear side disc (65) has a concentric aperture (66) whose diameter corresponds substantially to the diameter of the top of the bottle (3).

4. A contact pressure element according to claim 1, characterized in that the front side end faces of the ribs (33) lie in a common plane and the width of the ribs (33) corresponds substantially to the width of the gaps (34).

5. A contact pressure element according to claim 1, characterized in that the plate (40,50) has a parting slit (19, 20) dividing it into two discs (41, 42, 51, 52), and the front side disc (41, 51) has radial notchings (36) by which webs (37) are formed which do not overlap one another when they bear against the neck of the bottle (3).

6. A contact pressure element according to claim 1, characterized in that the plate has a parting slit dividing it into two discs, and the rear side disc (52) is resiliently deformable between a flat, undeformed condition and a bearing, deformed condition.

7. A contact pressure element according to claim 1, characterized in that the peripheral edge of the front side of the plate is formed with an annular bead.

8. A contact pressure element according to claim 1, characterized in that the flexible plate (2, 14, 40, 50) is retained by a retaining ring (5, 15, 45, 55).

9. A contact pressure element according to claim 8, characterized in that the retaining ring (15, 45, 55) has at the front side a resilient lip (22, 48, 58) which engages over the plate (14, 40, 50) at the edge.

* * * * *